US005914467A

United States Patent [19]

Jonas et al.

[11] Patent Number: 5,914,467

[45] Date of Patent: Jun. 22, 1999

[54] AUTOMATIC TRANSFER SWITCH WITH IMPROVED POSITIONING MECHANISM

[75] Inventors: Jeffery J. Jonas; Robert D. Kern, both of Waukesha; Gerald C. Ruehlow, Oconomowoc, all of Wis.

[73] Assignee: Generac Power Systems, Inc., Waukesha, Wis.

[21] Appl. No.: 08/909,142

[22] Filed: Aug. 11, 1997

[51] Int. Cl.[6] ..... H01H 9/20

[52] U.S. Cl. ..... 200/1 R; 200/17 R; 200/50.21; 200/50.26; 307/64

[58] Field of Search ..... 200/1 R, 17 R, 200/18, 50.12, 50.17, 50.21–50.27, 50.32, 50.33, 50.37–50.4; 307/43, 64, 65, 69, 80, 85; 361/605–609, 615–621

[56] References Cited

U.S. PATENT DOCUMENTS

| | | | |
|---|---|---|---|
| 3,697,709 | 10/1972 | Witkor | 200/48 R |
| 4,157,461 | 6/1979 | Wiktor | 200/18 |
| 4,398,097 | 8/1983 | Schell et al. | 307/64 |
| 4,423,336 | 12/1983 | Iverson et al. | 307/64 |
| 4,491,896 | 1/1985 | Rickmann | 361/339 |
| 4,590,387 | 5/1986 | Yoshida et al. | 307/64 |
| 4,724,512 | 2/1988 | Bischof et al. | 361/357 |
| 4,760,278 | 7/1988 | Thomson | 307/64 |
| 4,937,403 | 6/1990 | Minoura et al. | 200/50 AA |
| 5,023,469 | 6/1991 | Bassett et al. | 307/64 |
| 5,436,415 | 7/1995 | Smith et al. | 200/50 C |
| 5,638,948 | 6/1997 | Sharaf et al. | 200/401 |

*Primary Examiner*—Michael A. Friedhofer
*Attorney, Agent, or Firm*—Jansson, Shupe, Bridge & Munger, Ltd.

[57] ABSTRACT

Disclosed is an automatic transfer switch (ATS) having "operate," "test" and "isolate" positions for the switch per se. A handle selects one of the positions and a mechanical linkage couples the ATS and the handle to one another. In the improvement, the linkage has first and second members for applying motive force to the switch. The mechanical linkage has first and second rotary driver devices in engagement with the first and second members, respectively, thereby providing redundant switch-positioning mechanisms. The new ATS may be combined with a bypass switch having "normal," "auto" and "emergency" contact positions. A switch interlock linkage extends between the transfer switch and the bypass switch and includes a bypass plate and a transfer plate coupled to one another by a bar. The bypass switch includes a pivot-mounted first bypass interlock member obstructing substantial movement of the bypass plate when the bypass switch electrical contacts are in the "normal" position. And the transfer switch includes a pivot-mounted first transfer interlock member obstructing substantial movement of the transfer plate when the transfer switch electrical contacts are in the "emergency" position.

13 Claims, 6 Drawing Sheets

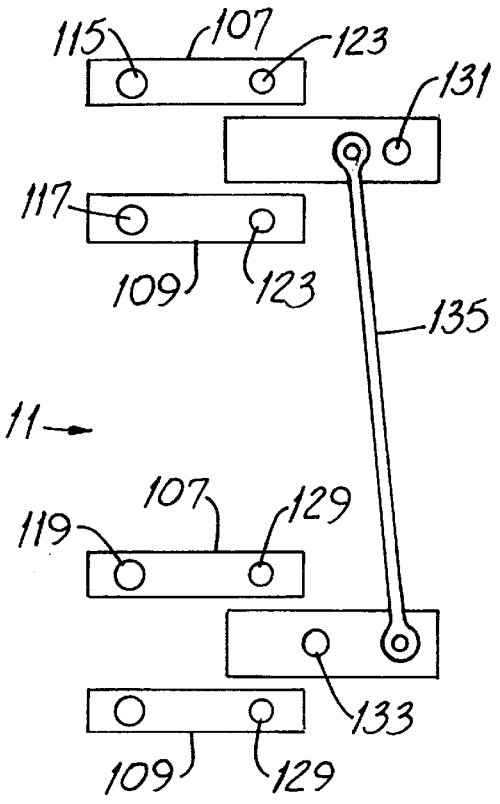
FIG. 11
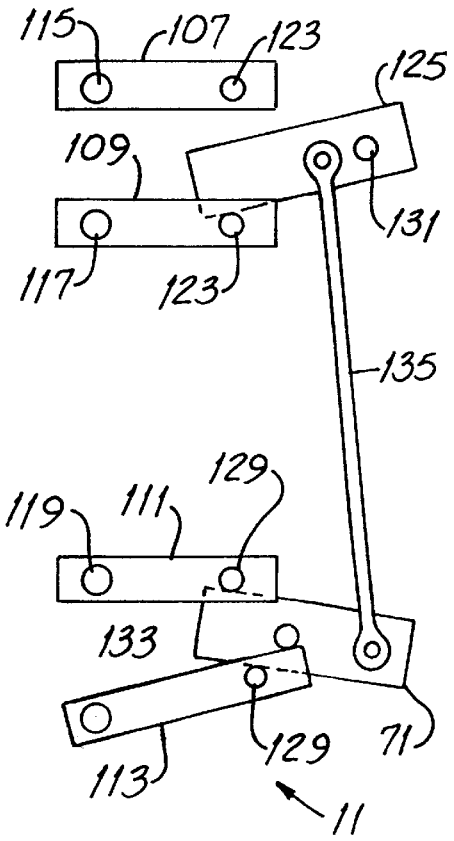
FIG. 12
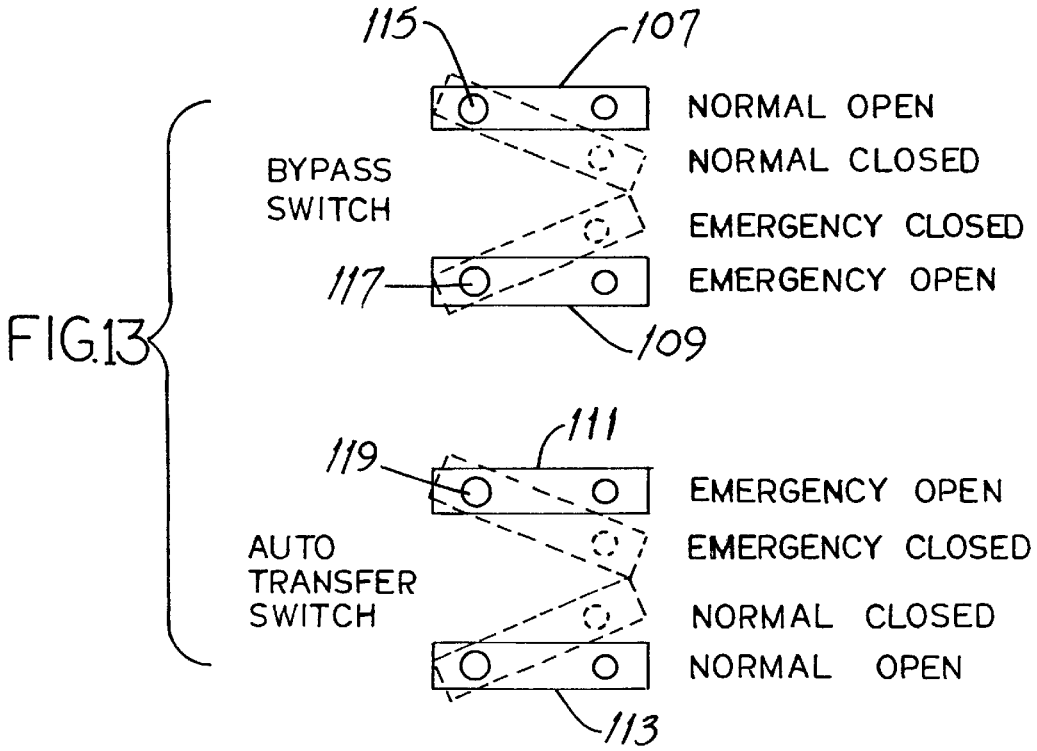

AUTOMATIC TRANSFER SWITCH WITH IMPROVED POSITIONING MECHANISM

FIELD OF THE INVENTION

This invention relates generally to electrical transmission or interconnect systems and, more particularly, to such systems involving a substitute or emergency energy source and using switches with interlocks.

BACKGROUND OF THE INVENTION

Virtually all facilities which use electrical power receive such power from a utility company. Utilities have an excellent record of providing uninterrupted or only-infrequently-interrupted power at proper voltages and line frequency. And when power fails, it usually does so for only a short duration amounting to little more than aggravation. Facility users simply tolerate the occasional disruption of service.

But certain types of facilities, e.g., hospitals and similar critical care institutions, unusual types of manufacturing plants and the like, cannot tolerate a power outage of any significant duration. Those types of facilities are equipped with a standby power system comprising an internal combustion engine driving an electrical generator. When commercial power fails, the engine is automatically started. And when the generator reaches rated voltage and frequency, an automatic transfer switch (ATS) transfers the load imposed by facility equipment from the commercial power lines to the generator. A typical ATS is configured so that its "normal" and "emergency" electrical contacts are electrically operated using solenoid coils. Switches of the foregoing type are disclosed in U.S. Pat. No. 4,157,461 (Wiktor); U.S. Pat. No. 4,423,336 (Iverson et al.); U.S. Pat. No. 4,590,387 (Yoshida et al.) (describing a single transfer switch); U.S. Pat. No. 4,937,403 (Minoura et al.) and U.S. Pat. No. 5,023,469 (Bassett et al.).

If automatic transfer switches (ATS) never failed, it would be the only switch needed to accomplish the foregoing. But for any one of a variety of reasons, failures occur, albeit infrequently. Such reasons include failure or maladjustment of small control-type limit switches, damage to control circuit bridge rectifiers caused by electrical surges, burned-out solenoid coils and even, occasionally, damage caused by disturbances on the commercial power line.

For service-related purposes, a known ATS is configured so that the entirety of the ATS moves on a sliding platform or the like between "operate," "test" and "isolate" positions. The Bassett et al. patent discloses a retractable table for the purpose.

In the first position, the ATS operates to automatically transfer the load to an emergency power source if the normal power source fails. In the second, the ATS control circuit (but not all of the main power-carrying contacts) are connected to the normal power source so that the ATS can be tested or "cycled" through its functions without actually transferring electrical load. In the third position, the ATS is entirely disconnected from the normal power source and can be physically removed for bench service.

The Wiktor patent discloses a mechanism for moving the ATS toward and away from the bypass switch for normal ATS operation or for its testing or removal. The mechanism includes what is often referred to as a bell crank arrangement. The force required to be exerted on the positioning handle varies with the effective lever-arm-length of a link. The Wiktor mechanism is configured so that when moving the ATS from its normal position toward its test position (which requires separation of electrical contacts), the effective length of the link is shortest and highest hand force is required. And assuming the handle moves at a constant angular velocity, the rate of movement of the ATS changes with changes in the effective lever-arm-length of the link.

The ATS withdrawal mechanism disclosed in the Iverson et al. patent is similar to that of the Wiktor patent in that it uses a bell crank arrangement having an effective lever-arm-length which changes as the ATS moves. In the Iverson et al. mechanism, the user rotates a crank which, through a shaft, provides input power to a gearbox. The gearbox output drives a crank arm coupled to a locking bar which, in turn engages a pin on the ATS.

Because automatic transfer switches fail or need occasional service, manufacturers of equipment of this type provide a second, manually-operated bypass switch as a "backup" device. With proper human intervention, the bypass switch also transfers a load between a normal power source and an emergency source. In other words, the bypass switch is essentially redundant in that it performs substantially the same function as the automatic transfer switch. As with an ATS, a bypass switch has a set of "normal" contacts to connect the load to the commercial power line and a set of "emergency" contacts to connect the load to the generator.

Because the automatic transfer switch and the bypass switch both have the described capability of load switching between power sources, great care must be taken to design the switches and their ancillary hardware to assure that the commercial power lines and the generator are not connected to one another. An improperly-designed switch or switch combination could result in such interconnection if (a) the emergency contacts closed before the normal contacts open or vice versa, or if (b) the relative positions of the automatic transfer switch and the bypass switch are not coordinated to prevent such interconnection. (All known manufacturers of individual switches and automatic transfer switch/bypass switch combinations have long since recognized and addressed these concerns.)

A common way to assure that one set of contacts, e.g., the normal contacts, are open before the other set of contacts, e.g., the emergency contacts, close is by using contact "underlap." That is, the switch is constructed in such a way that absent component failure of some sort, simultaneous normal and emergency contact closure is impossible. And a common way to assure that the relative positions of the automatic transfer switch and the bypass switch are properly coordinated to prevent the aforedescribed power line/generator interconnection is by using some sort of interlock arrangement.

Interlock arrangements occur in two broad types, namely, electrical and mechanical. Of these, electrical interlocking is believed to be more common. In general, an electrical interlock system works as follows. Small electrical control switches are in series with the electromagnetic coils energized to close the "normal contactor" (the contactor having the normal contacts thereon) and the emergency contactor. As an example of interlocked operation, the coil for the emergency contactor cannot be energized until the control switch in series with it is closed by the normal contactor having moved to the full open position.

But mechanical interlocks are certainly not unknown. The Bassett et al. patent noted above discloses such an interlock. The interlock system of the Bassett et al. patent might be termed a hybrid in that it has both electromechanical and purely mechanical aspects. The system is configured to prevent the automatic transfer switch and the bypass switch from being simultaneously closed on different, i.e., normal and emergency, sources. Movement of the automatic transfer switch between AUTO, TEST and ISOLATION positions is by another mechanism, only a few components of which are disclosed.

While the known ATS positioning mechanisms have been generally suited for the purpose, they are not without disadvantages. The above-described variable hand force and apparent high hand force are among them. And it appears that the positioning mechanism shown in the Iverson et al. patent acts upon a single point on the ATS being moved. "Cocking" during movement may occur unless the single point is centered on the ATS and the frictional load at the lateral extremities of the ATS are about equal to one another.

Another disadvantage relates to the matter of redundancy. The ATS positioning mechanisms of the Wiktor and Iverson et al. patents use only a single mechanism. There is no redundancy in the event of a failure of such mechanism.

Similarly, certain known mechanical interlock mechanisms are characterized by a good deal of complexity. The interlock system disclosed in the Bassett et al. patent is an example. Electromechanical interlock systems place at least some reliance upon the integrity of electrical coils, small electrical switches and the like. The circuit disclosed in the Bassett et al. patent is an example.

An automatic transfer switch with an improved positioning mechanism and which, when combined with a bypass switch, includes a straightforward yet highly effective interlock mechanism would be a distinct advance in the art.

OBJECTS OF THE INVENTION

It is an object of the invention to provide an automatic transfer switch with an improved positioning mechanism.

Another object of the invention is to provide an automatic transfer switch having a positioning mechanism which, in one embodiment, has redundant operating components.

Another object of the invention is to provide an automatic transfer switch having a positioning mechanism which is easy to manufacture and mount.

Still another object of the invention is to provide an automatic transfer switch having a positioning mechanism combined with a bypass switch and a related interlock mechanism.

Another object of the invention is to provide an automatic transfer switch having a positioning mechanism combined with a bypass switch and a related interlock mechanism, all configured to help assure that when both have closed contacts, those of the transfer switch and the bypass switch are in parallel. How these and other objects of the invention are accomplished will become apparent from the following descriptions and from the drawings.

SUMMARY OF THE INVENTION

The invention involves an automatic transfer switch having, with respect to a support structure or frame, "operate," "test" and "isolate" positions. A handle selects one of the positions and a mechanical linkage couples the switch and the handle to one another. The electrical contacts in the transfer switch have "normal," "open" and "emergency" contact positions.

In the improvement, the switch includes first and second driven members, e.g., projecting pins, fixed to the switch for applying motive force thereto. The linkage has first and second rotary driver devices in engagement with the first and second members, respectively. There is a separate driven member and driver device on each side of the switch, thereby providing redundant switch-positioning mechanisms.

In a more specific aspect of the invention, each device has a notch and an axis of rotation and each member engages the notch of its respective driver device. At least one member is at a first distance from the axis of rotation of its respective driver device when the switch is in the "operate" position and is at a greater second distance from the axis of rotation of its respective driver device when the switch is in the "isolate" position.

In another aspect of the invention, the switch moves along a position axis when moving between any two positions. The first and second driven members are spaced along a lateral axis generally normal to the position axis.

In yet another aspect of the invention, the first and second driven members move along respective travel axes. Each of the first and second rotary driver devices includes a notch having a leading edge. When the switch is in the "operate" position, the first and second members are, respectively, in the notches of the first and second devices. And when the switch is in the "isolate" position, the leading edges are spaced from the respective travel axes, thereby permitting the switch to be withdrawn from the frame.

To put it in different words, the rotary driver devices interfere with forward movement of the driven members unless the switch has been moved to the "isolate" position. In such position, the mouths of the notches face forward so that the driven members are free to be withdrawn out of the notches.

The automatic transfer switch may be used in combination with a bypass switch having "normal," "auto" and "emergency" electrical contact positions. A switch interlock linkage extends between the transfer switch and the bypass switch and includes a bypass plate and a transfer plate coupled to one another by a bar. The bypass switch includes a pivot-mounted first bypass interlock member obstructing substantial movement of the bypass plate when the bypass switch contacts are in the "normal" position. Similarly, the transfer switch includes a pivot-mounted first transfer interlock member obstructing substantial movement of the transfer plate when the transfer switch contacts are in the "emergency" position.

In another aspect of the invention, the bypass switch also includes a pivot-mounted second bypass interlock member obstructing substantial movement of the bypass plate when the bypass switch contacts are in the "emergency" position. Similarly, the transfer switch includes a pivot-mounted second transfer interlock member obstructing substantial movement of the transfer plate when the transfer switch contacts are in the "normal" position.

In a highly preferred embodiment, the bypass plate is a third class lever, the transfer plate is a first class lever and both plates are mounted for pivoting rotation in either a clockwise or a counterclockwise direction. In a particular aspect of operation, when the bypass plate rotates clockwise, the transfer plate simultaneously rotates counterclockwise.

Further details of the invention are set forth in the following detailed description and in the drawings.

BRIEF DESCRIPTION OF THE DRAWINGS

FIG. 11 is a side elevation view of certain components of a mechanism of the automatic transfer switch showing positions of such components.

FIG. 12 is another side elevation view of the components of FIG. 11 showing other positions thereof.

FIG. 13 is a representative side elevation view showing, in solid and dashed outline, certain positions of components of an automatic transfer switch and a bypass switch.

DETAILED DESCRIPTION OF PREFERRED EMBODIMENTS

Figure 1:
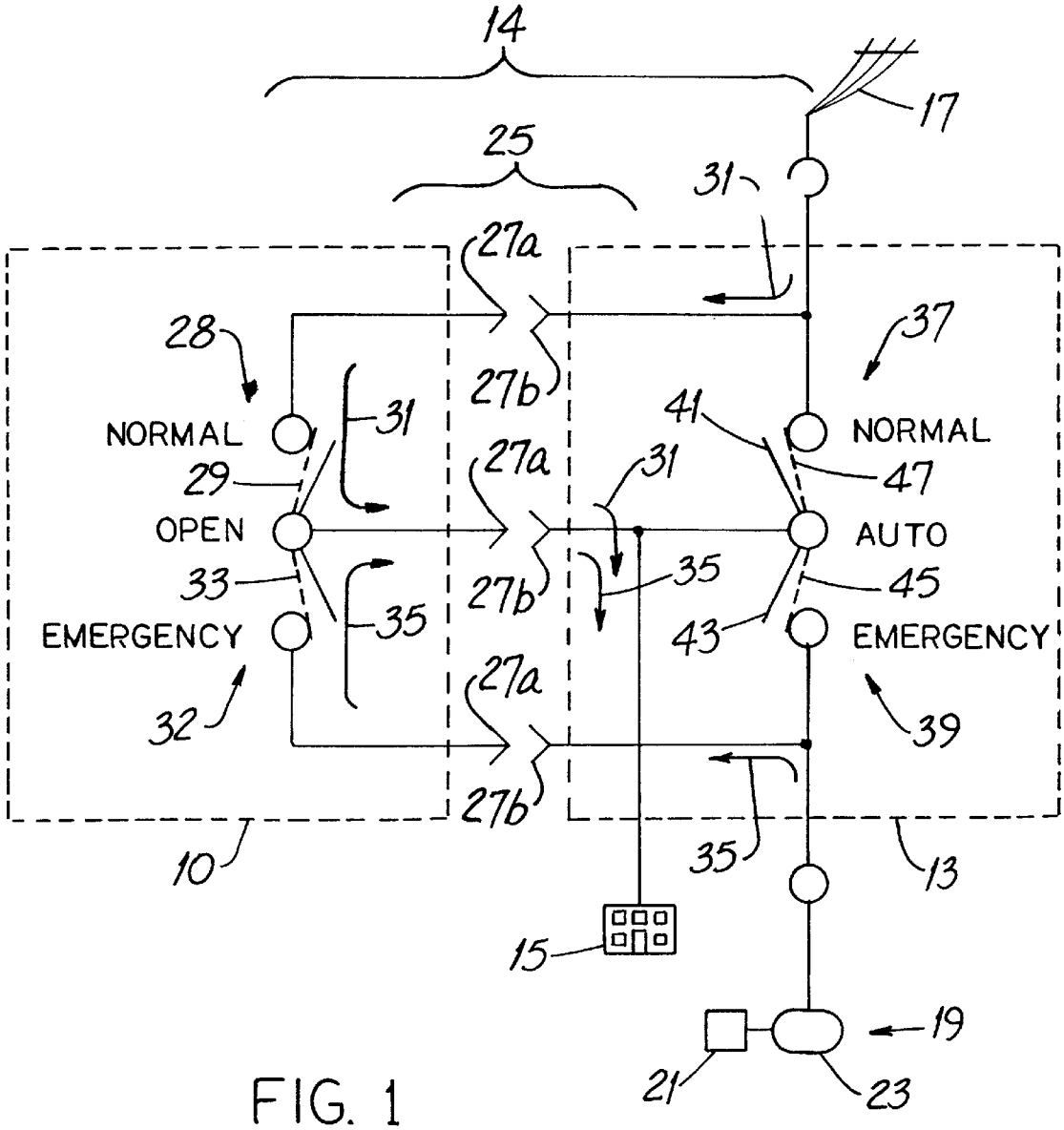
FIG. 1 PRIOR ART
FIG. 1 is a line diagram of an exemplary three-phase power system in which an automatic transfer switch and a bypass switch are connected. Certain aspects of the system are represented by "pictograms," electrical contacts are shown in solid line in their open positions and in dashed line in their closed positions.

Before describing the new automatic transfer switch 10 and the related switch interlock linkage 11, it will be helpful to have an understanding of how an automatic transfer switch 10 and a bypass switch 13 are installed in an electrical system 14 and how the switches 10, 13 operate. Referring to FIG. 1, the electrical "load" (the equipment in a hospital 15, for example) is normally powered by the electrical utility lines 17. The exemplary hospital 15 is equipped with an emergency power source 19 comprising an internal combustion engine 21 mechanically coupled to an electrical generator 23.

Figure 2:
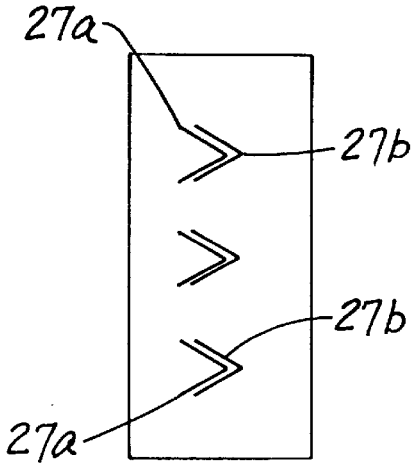
FIG. 2 PRIOR ART
Figure 3:
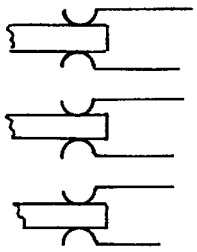
FIG. 3 PRIOR ART

Connected in the system 14 is a transfer switch 10 and a bypass switch 13 which, together, comprise what is known as a bypass isolation switch 25. In conventional operation when power is available from the lines 17, the stab-type contacts 27*a*, 27*b* are engaged with one another as represented by FIGS. 2 and 3 and the "normal" electrical contacts 28 are closed as represented by the dashed line 29. In that configuration, power flows from the lines 17 to the load (e.g., the hospital 15) as represented by the arrows 31.

If no power is available from the lines 17, the engine 21 is started automatically and the output voltage and frequency of the generator 23 are detected by known means. When the voltage and frequency are within specified ranges, the emergency power source 19 is said to be "qualified," the "normal" electrical contacts 28 are then opened and the "emergency" electrical contacts 32 closed, the latter as represented by the dashed line 33. Thereupon, power flows from the generator 23 to the load as represented by the arrows 35.

During operation as described above, the "normal" and "emergency" electrical contacts 37, 39, respectively, of the bypass switch 13 are open as represented by the solid lines 41, 43, respectively. When both such contacts 37, 39 are open, the bypass switch is said to be in the "auto" position, i.e., the position anticipating normal operation of the automatic transfer switch 10.

It is next assumed that service work, e.g., testing or outright removal from the system 14, is to be performed with respect to the transfer switch 10. Of course, such service work cannot be undertaken without taking steps to assure that the load is continuously supplied with power, whether from the lines 17 or from the generator 23.

Before undertaking service work on the transfer switch 10, electrical contacts 37 or 39 of the bypass switch 13 are manually switched to an appropriate position to take over the task of the transfer switch 10 of supplying power to the load. An "appropriate" position is one in which electrical contacts of the switches 10, 13 are in parallel (rather than in series) so that the bypass switch 13 connects the load to the same power source, i.e., the lines 17 or generator 23, as that from which the transfer switch 10 is directing power to the load.

As an example, if the transfer switch "emergency" contacts 32 are closed to the position of the dashed line 33, the bypass switch "emergency" contacts 43 must first be closed to the position represented by the dashed line 45 before service work can be performed on the transfer switch 10. (And, of course, if the transfer switch "normal" contacts 28 are closed to the position of the dashed line 29, the bypass switch "normal" contacts 37 must first be closed to the position represented by the dashed line 47 prior to service work.) The interlock linkage 11 described below helps prevent contact closure otherwise than as appropriate.

Figure 5:
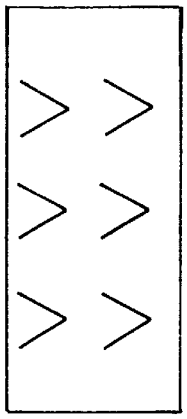
FIG. 5 PRIOR ART
FIGS. 2, 3, 4, 5 and 6 show various positions of contacts of an automatic transfer switch.
Figure 4:
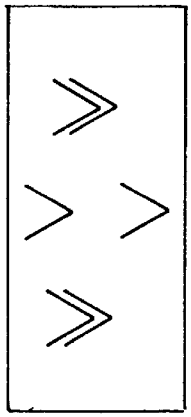
FIG. 4 PRIOR ART
Figure 6:
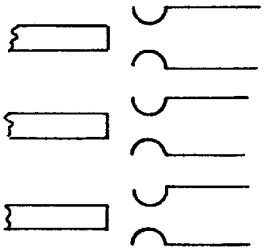
FIG. 6 PRIOR ART

For this part of the explanation, it is assumed that the "normal" electrical contacts 28 of the transfer switch 10 are closed and the load is being fed from the lines 17. To carry out service work on the transfer switch 10, the "normal" electrical contacts 37 of the bypass switch 13 are manually closed and are in parallel with the "normal" electrical contacts 28 of the transfer switch 10. The entire transfer switch 10 (including its electrical contacts 28, 32 within) can then be moved from the "operate" position represented by FIGS. 2 and 3 and to the "test" position as represented by FIG. 4. If necessary, the entire switch 10 can be further moved to the "isolate" position as represented by the FIGS. 5 and 6 and lifted away from the frame 51 (shown in FIG. 7) for bench repair.

Figure 8:
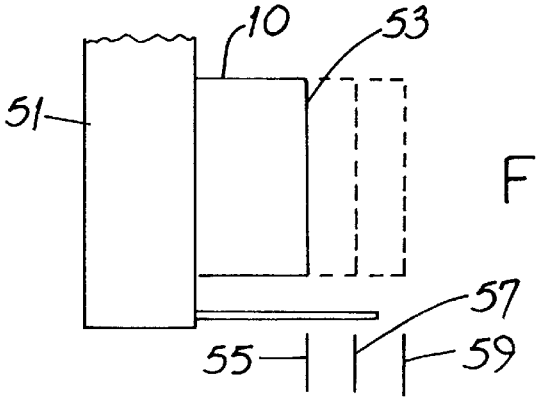
FIG. 8 showing three positions of the transfer switch with respect to respective reference lines.

Referring to FIG. 8, the transfer switch is in the "operate" position when its outward face 53 is in registry with the position line 55, is in the "test" position when in registry with the position line 57 and is in the "isolate" position when in registry with the position line 59.

Figure 7:
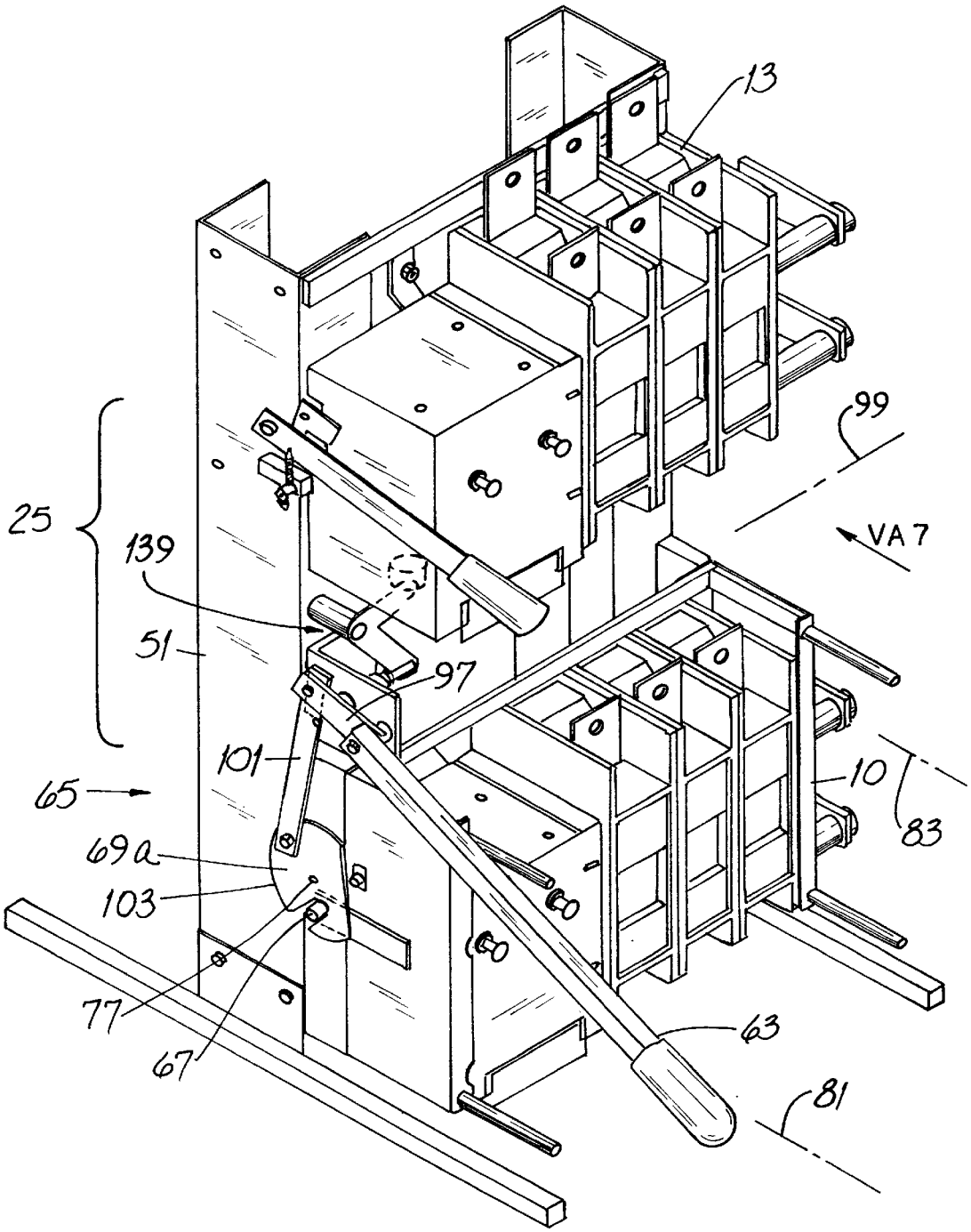
FIG. 7 is a perspective view of an automatic transfer switch embodying the invention.
Figure 9:
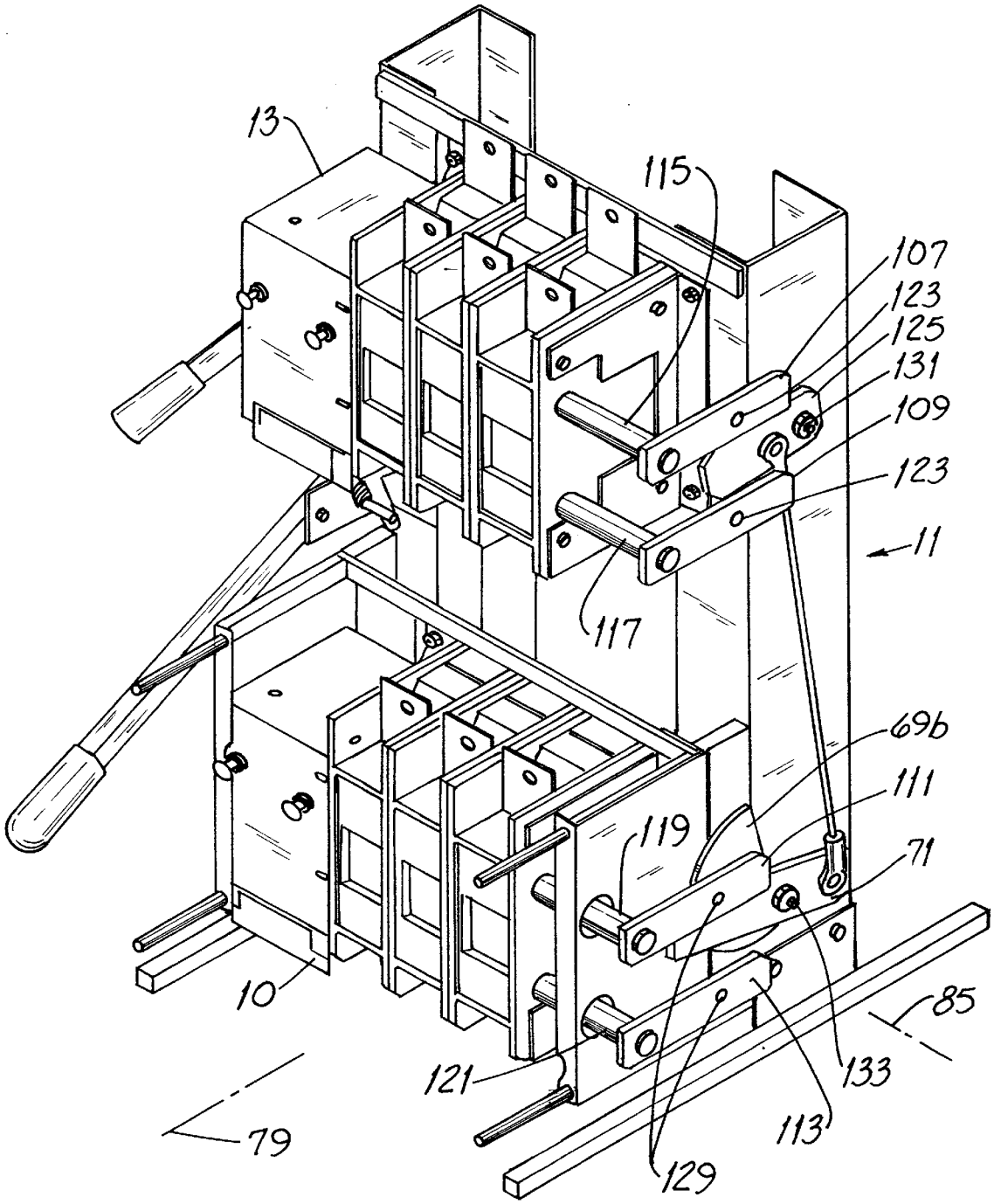
FIG. 9 is another perspective view of the automatic transfer switch of FIG. 7.

Referring next to FIGS. 7 and 9, terms such as "left" and "right" are with respect to one facing the bypass isolation switch 25, i.e., to one viewing the automatic transfer switch 10 along the viewing axis VA7 of FIG. 7. The switch 10 has a handle 63 to select one of the positions "operate," "test" or "isolate" and a switch-positioning mechanism 65 comprising a mechanical linkage couples the switch 10 and the handle 63 to one another.

Figure 10:
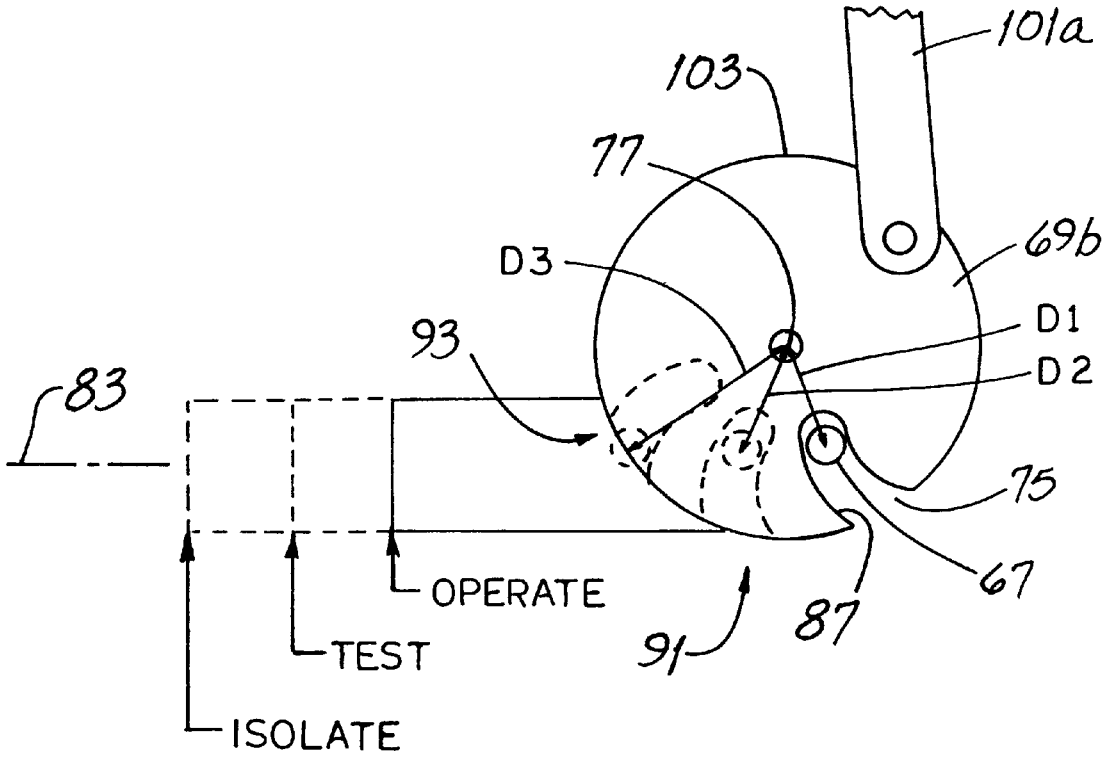
FIG. 10 is a side elevation view of certain components of a mechanism of the automatic transfer switch. A position is shown in solid outline and two other positions are shown in dashed outline.

In a highly preferred embodiment, the switch 10 includes first and second driven members, e.g., projecting pins 67, fixed to the switch 10 for applying horizontal motive force thereto. (In FIG. 9, the right-side driven pin 67 is hidden from view by the transfer plate 71, but such pin 67 is shown in FIG. 10.) The linkage has first and second rotary driver devices 69*a*, 69*b*, respectively, in engagement with respective pins 67. There is a separate pin 67 and driver device 69 on each side of the switch 10, thereby providing redundant switch-positioning mechanisms.

It is to be appreciated that the switch 10 may, less preferably, be configured with only one pin 67 and driver device 69 and still be operable to urge the switch 10 away from the frame 51.

Although it is preferred that two driver devices 69*a*, 69*b* and related pins 67 be used to move the position of the switch 10, details of only one such driver device 69*b* and pin 67 need be described. Referring particularly to FIGS. 7, 9 and 10, has a notch 75 and an axis of rotation 77 and the pin 67 engages the notch 75 of its respective driver device 69*b*. The pin 67 is at a distance D1 from the axis of rotation 77 of its driver device 69*b* when the switch 10 is in the "operate" position, is at a greater distance D2 from the axis of rotation 77 of the driver device 69*b* when the switch 10 is in the "test" position and is at a still greater distance D3 from the axis of rotation 77 of the device 69*b* when the switch 10 is in the "isolate" position.

The switch 10 moves along a position axis 79 when moving between any two positions, the first and second pins 67 move along respective travel axes 81, 83 and the pins 67 are spaced along a lateral axis 85 generally normal to the position axis 79. Each of the first and second rotary driver devices 69*a*, 69*b* includes a notch 75 like that shown in FIG. 10 and having a leading edge 87. When the switch 10 is in the "operate" position, the first and second pins 67 are, respectively, in the notches 75 of the first and second devices 69*a*, 69*b*. And when the switch 10 is in the "isolate" position, the leading edges 87 are spaced from the respective travel axes 81, 83, thereby permitting the switch 10 to be withdrawn from the frame 51. In FIG. 10, the positions of the right-side rotary driver device 69*b*, its notch 75 and the pin 67 are shown in solid outline when the switch 10 is in the "operate" position. The positions of the device 69*b*, the notch 75 and the pin 67 when the switch 10 is in the "test" position are shown in dashed outline at the location 91. And the positions of the device 69*b*, the notch 75 and the pin 67 when the switch 10 is in the "isolate" position are shown in dashed outline at the location 93.

To put it in different words, unless the rotary driver devices 69 are themselves urging the switch 10 forward away from the frame 51, such devices 69 interfere with forward movement of their respective pins 67 unless the switch 10 has been moved to the "isolate" position. In the "isolate" position, the mouths of the notches 75 are open so that the pins 67 are free to be withdrawn out of the notches 75.

Referring again to FIG. 7, a specific mechanism 65 includes an extension link 97, the proximal end of which is rigidly coupled to the handle 63 for coincident pivoting movement about the pivot axis 99. A coupling link 101 has one of its ends pivotally pinned to the distal end of the link 97 and the other of its ends pivotally pinned to the device 69*a* adjacent to the device perimeter 103.

When the handle 63 is raised or lowered, the link 97 pivots about the axis 99 and the link 101 moves generally downwardly or upwardly, respectively, and rotates the device 69*a* about axis 77. The device 69*a* thereupon urges the pin 67 forwardly or rearwardly, respectively, as described above in connection with FIG. 10. FIG. 10 shows device 69*b*, its pin 67 and its coupling link 101*a*.

Referring next to FIGS. 1, 7, 9 and 11–13, the automatic transfer switch 10 may be used in combination with a bypass switch 13 having "normal," "auto" and "emergency" electrical contact positions. Before describing the switch interlock linkage 11, it will be helpful to have an understanding of aspects of the interlock members 107, 109 and 111, 113 associated with the bypass switch 13 and the transfer switch 10, respectively.

The bypass switch 13 includes a first bypass interlock member 107 rigidly mounted to and pivoting with a shaft 115 extending from the shaft used to operate the "normal" contacts 37 of the bypass switch 13. When such "normal" contacts 37 close, the member 107 is rotated in the clockwise direction from the position shown in FIGS. 9 and 13 to the position shown in dashed outline in FIG. 13.

The bypass switch 13 also includes a second bypass interlock member 109 rigidly mounted to and pivoting with a shaft 117 extending from the shaft used to operate the "emergency" contacts 39 of the bypass switch 13. When such "emergency" contacts 39 close, the member 109 is rotated in the counterclockwise direction from the position shown in FIGS. 9 and 13 to the position shown in dashed outline in FIG. 13.

Similarly, the transfer switch 10 includes a first transfer interlock member 111 rigidly mounted to and pivoting with a shaft 119 extending from the shaft used to operate the "emergency" contacts 32 of the transfer switch 10. When such "emergency" contacts 32 close, the member 111 is rotated in the clockwise direction from the position shown in FIGS. 9 and to the position shown in dashed outline in FIG. 13.

The transfer switch 10 also includes a second transfer interlock member 113 rigidly mounted to and pivoting with a shaft 121 extending from the shaft used to operate the "normal" contacts 28 of the transfer switch 10. When such "normal" contacts 28 close, the member 113 is rotated in the counterclockwise direction from the position shown in FIGS. 9 and 13 to the position shown in dashed outline in FIG. 13.

The bypass interlock members 107, 109 each include a lug 123 projecting toward the switch 10. The lugs 123 overlap and, under certain conditions, obstruct the path of pivoting travel of the bypass plate 125. Similarly, the transfer interlock members 111, 113 each include a lug 129 projecting toward the switch 10 so as to overlap and, under certain conditions, obstruct the path of pivoting travel of the transfer plate 71. The switch interlock linkage 11 will now be described.

Referring now to FIGS. 9, 11 and 12, the switch interlock linkage 11 extends between the transfer switch 10 and the bypass switch 13 and includes the bypass plate 125 and the transfer plate 71 pivot-mounted to the frame 51 at the locations 131, 133, respectively. The plates 125, 71 are coupled to one another by a bar 135. But for circumstances in which plate movement is obstructed (as described below), the plates 125, 71 and bar 135 are freely pivoting. In a highly preferred embodiment, the bypass plate 125 is a third class lever, the transfer plate 71 is a first class lever and both plates 125, 71 are mounted for pivoting rotation in either a clockwise or a counterclockwise direction.

Considering FIGS. 9 and 11, when both switches 10, 13 are open, the bypass interlock members 107, 109 and the transfer interlock members 111, 113 are in their respective positions as shown. In such positions, the plates 125, 71 are free to pivot.

When considering FIG. 12, it is assumed that, in the example explained above, the "normal" contacts 28 of the transfer switch 10 are closed. Therefore, the second transfer interlock member 113 is pivoted counterclockwise to the position shown and the lug 129 of the member 113 has pivoted the transfer plate 71 clockwise to the position shown. Pivoting of the plate 71 causes the bar 135 to move downwardly and pivot the plate 125 in a counterclockwise direction to the position shown.

In view of the fact that the bypass interlock member 109 pivots counterclockwise from the position in FIG. 12 when the "emergency" contacts 39 of the bypass switch 13 are moved toward closure, the plate 125 would obstruct such pivoting movement and prevent it. Therefore, one is prevented from closing the "emergency" contacts 39 of the bypass switch 13 when the "normal" contacts 28 of the transfer switch 10 are closed. However, one may close the "normal" contacts 37 of the bypass switch 13 (preparatory to removing the transfer switch 10 from service, for example) since clockwise rotation of the bypass interlock member 107 is not obstructed when the linkage 11 is in the position of FIG. 12.

Given the foregoing description and the drawings, it will be apparent to one of ordinary skill that when the "emergency" contacts 32 of the transfer switch 10 are closed, the first transfer interlock member 111 will be at the position shown in dashed outline in FIG. 13. The member 111 pivots the interlock linkage 11 (and, particularly, the bypass plate 125) to a position such that the plate 125 obstructs closure of the "normal" contacts 37 of the bypass switch 13 by obstructing pivoting movement of the interlock member 107. However, closure of the "emergency" contacts 39 of such switch 13 would not be obstructed.

Referring further to FIGS. 1 and 7, the switch 25 preferably includes a mechanism 139 which prevents the automatic transfer switch 10 from being moved outwardly unless the bypass switch 13 is in operative position. In such operative position, one of the sets of contacts 37, 39 of the bypass switch 13 is closed. When either set of contacts 37 or 39 is closed, the round plunger moves upwardly, permitting the V-shaped lever (which is springbiased in a counterclockwise direction) to rotate in such direction. The pin attached to such lever is thereby withdrawn rightwardly to a position which does not obstruct movement of handle 63. Such handle 63 can then be raised.

While the principles of the invention have been shown and described in connection with a few preferred embodiments, it is to be understood clearly that such embodiments are by way of example and are not limiting.

What is claimed:

1. In an automatic transfer switch having "operate," "test" and "isolate" positions and including a handle for selecting one of the positions and a mechanical linkage coupling the switch and the handle to one another, the improvement wherein:

the switch includes first and second driven members for applying motive force to the switch; and the linkage includes first and second rotary driver devices in engagement with the first and second members, respectively, thereby providing redundant switch-positioning mechanisms.

2. The switch of claim 1, wherein:

each of said first and second rotary driver devices has a notch and an axis of rotation;

each of said first and second driven members engages said notch of said first and second rotary driver devices, respectively;

at least one member of said first and second driven members is at a first distance from said axis of rotation of a respective one of said first and second rotary driver devices, when said switch is in said "operate" position;

said at least one member of said first and second driven members is at a second distance from said axis of rotation of said respective one of said first and second rotary driver devices, when said switch is in said "isolate" position; and said second distance is different than said first distance.

3. The switch of claim 2, wherein said second distance is greater than said first distance.

4. The switch of claim 3, wherein:

said switch moves along a position axis when moving between any two positions of said "operate," "test" and "isolate" positions; and said first and second driven members are spaced along a lateral axis generally normal to said position axis.

5. The switch of claim 1 wherein:

the switch is mounted in a frame;

the first and second members move along respective travel axes;

each of the first and second devices includes a notch having a leading edge;

when the switch is in the "operate" position, the first and second members are, respectively, in the notches of the first and second devices; and when the switch is in the "isolate" position, the leading edges are spaced from the respective travel axes, thereby permitting the switch to be withdrawn from the frame.

6. The automatic transfer switch of claim 1 in combination with a bypass switch having "normal," "auto" and "emergency" contact positions and wherein:

the transfer switch and the bypass switch each have electrical contacts;

the transfer switch has "normal," "open" and "emergency" contact positions;

a switch interlock linkage extends between the transfer switch and the bypass switch and includes a bypass plate and a transfer plate coupled to one another by a bar;

the transfer switch includes a pivot-mounted first transfer interlock member obstructing substantial movement of the transfer plate when the transfer switch contacts are in the "emergency" position; and the bypass switch includes a pivot-mounted first bypass interlock member obstructing substantial movement of the bypass plate when the bypass switch contacts are in the "normal" position.

7. The combination of claim 6 wherein:

the bypass plate is a third class lever; and the transfer plate is a first class lever.

8. The combination of claim 6 wherein:

the bypass switch includes a pivot-mounted second bypass interlock member obstructing substantial movement of the bypass plate when the bypass switch is in the "emergency" position; and the transfer switch includes a pivot-mounted second transfer interlock member obstructing substantial movement of the transfer plate when the transfer switch is in the "normal" position.

9. The combination of claim 8 wherein:

the bypass plate is a third class lever; and the transfer plate is a first class lever.

10. The automatic transfer switch of claim 1, in combination with a bypass switch having a "normal" electrical contacts position and wherein:

said transfer switch has a "normal" electrical contacts position which is closed when said transfer switch is in said "operate" position;

a switch interlock linkage extends between said transfer switch and said bypass switch and includes a bypass plate and a transfer plate coupled to one another by a bar;

said bypass switch includes a pivot-mounted bypass interlock member obstructing substantial movement of said bypass plate, when bypass switch is in said "normal" electrical contacts position; and said transfer switch includes a pivot-mounted transfer interlock member obstructing substantial movement of said transfer plate, when said transfer switch is in said "normal" electrical contacts position.

11. The combination of claim 10 wherein:

the bypass plate and the transfer plate are mounted for pivoting rotation; and when the bypass plate rotates clockwise, the transfer plate simultaneously rotates counterclockwise.

12. In an automatic transfer switch having "operate," "test" and "isolate" positions and including a handle for selecting one of the positions and a mechanical linkage coupling the switch and the handle to one another, the improvement wherein:

the switch includes a driven member for applying motive force to the switch;

the linkage includes a rotary driver device having a notch and the member engages the notch for switch movement;

the device has an axis of rotation;

the driven member is at a first distance from the axis of rotation when the switch is in the "operate" position;

the driven member is at a second distance from the axis of rotation when the switch is in the "isolate" position; and the second distance is greater than the first distance.

13. The switch of claim 12 wherein:

the switch is mounted in a frame;

the member moves along a travel axis;

the notch has a leading edge;

when the switch is in the "operate" position, the leading edge is in registry with the travel axis; and when the switch is in the "isolate" position, the leading edge is spaced from the travel axis, thereby permitting the switch to be withdrawn from the frame.

* * * * *